US009605467B2

(12) United States Patent
Park

(10) Patent No.: US 9,605,467 B2
(45) Date of Patent: Mar. 28, 2017

(54) APPARATUS AND METHOD FOR CONTROLLING OPENING AND CLOSING OF VEHICLE WINDOWS

(71) Applicant: Hyundai Motor Company, Seoul (KR)

(72) Inventor: Soo Il Park, Gwangju (KR)

(73) Assignee: Hyundai Motor Company, Seoul (KR)

( * ) Notice: Subject to any disclaimer, the term of this patent is extended or adjusted under 35 U.S.C. 154(b) by 139 days.

(21) Appl. No.: 14/185,062

(22) Filed: Feb. 20, 2014

(65) Prior Publication Data

US 2015/0134207 A1 May 14, 2015

(30) Foreign Application Priority Data

Nov. 12, 2013 (KR) ..... 10-2013-0137101

(51) Int. Cl.
*E05F 15/695* (2015.01)
*E05F 15/40* (2015.01)

(52) U.S. Cl.
CPC ..... *E05F 15/695* (2015.01); *E05F 15/40* (2015.01); *E05Y 2800/424* (2013.01); *E05Y 2800/428* (2013.01)

(58) Field of Classification Search
CPC .. B60J 7/0573; B60R 25/2036; B60R 25/246; E05F 15/2007; G07C 2009/00769; G07C 2209/08; G07C 9/00309
See application file for complete search history.

(56) References Cited

U.S. PATENT DOCUMENTS

| | | | | |
|---|---|---|---|---|
| 6,542,071 | B1 * | 4/2003 | Ohtsubo | B60R 25/2036 340/10.1 |
| 2006/0006701 | A1 * | 1/2006 | Wells | B60J 7/0573 296/223 |
| 2008/0106116 | A1 * | 5/2008 | Boulakia | B60J 7/0573 296/107.01 |
| 2008/0119217 | A1 * | 5/2008 | Coxhill | H04M 1/67 455/550.1 |
| 2009/0207014 | A1 * | 8/2009 | Ayed | G08B 13/1427 340/539.13 |
| 2010/0178640 | A1 * | 7/2010 | Yachin | A61B 5/168 434/236 |
| 2015/0134207 | A1 * | 5/2015 | Park | E05F 15/695 701/49 |

FOREIGN PATENT DOCUMENTS

| | | | | |
|---|---|---|---|---|
| JP | 2007-169915 | * | 7/2007 | |
| KR | 10-2002-0085944 A | | 11/2002 | |
| KR | 10-2005-0023740 | | 3/2005 | |
| KR | 10-2005-0090600 | | 9/2005 | |
| KR | 10-2013-0053354 | | 5/2013 | |
| WO | WO 94/22212 | * | 3/1994 | E05F 15/02 |

* cited by examiner

*Primary Examiner* — Redhwan k Mawari
(74) *Attorney, Agent, or Firm* — Mintz Levin Cohn Ferris Glovsky and Popeo, P.C.; Peter F. Corless

(57) ABSTRACT

An apparatus and a method for controlling an opening and closing of vehicle windows are provided. The method includes receiving, by a controller, an open signal for at least one window disposed within the vehicle. Further, the controller detects a rainfall at an exterior of the vehicle using a sensor and opens and closes the windows based on the open signal and the detected rainfall.

11 Claims, 3 Drawing Sheets

APPARATUS AND METHOD FOR CONTROLLING OPENING AND CLOSING OF VEHICLE WINDOWS

CROSS-REFERENCE TO RELATED APPLICATION

This application claims the benefit of priority to Korean Patent Application No. 10-2013-0137101, filed on Nov. 12, 2013 in the Korean Intellectual Property Office, the disclosure of which is incorporated herein in its entirety by reference.

BACKGROUND

Field of the Invention

The present invention relates to an apparatus and a method for controlling an opening and closing of vehicle windows, and more particularly, an apparatus and a method for controlling opening and closing of vehicle windows to prevent the opening of the windows when water may flow into the interior of the vehicle due to rain by detecting an external environment of the vehicle when an open signal for windows is received.

Description of the Related Art

In a recently introduced vehicle, a sun-roof is provided with a roof panel to improve commercial value and ventilation in the vehicle and in a vehicle of an open car type, a convertible top that opens and closes the entire roof of the vehicle is provided. For vehicles that have the sun-roof or the convertible top water may flow into the interior of the vehicle when rain or snow is present.

Therefore, to prevent the rain or snow from entering the vehicle, a moisture sensor has been installed in vehicles in which the sun-roof or the convertible top is installed to automatically cover the sun-roof or the convertible top when the moisture sensor senses that the water is entering the interior of the vehicle. However, this method of sensing water flowing into the interior of the vehicle using the moisture sensor does not automatically close the sun-roof or convertible top until after the water has already started flowing into the vehicle. Therefore, the inflow of water is not prevented before damage has already occurred.

SUMMARY

The present invention provides an apparatus and a method for controlling an opening and closing of vehicles windows to prevent an opening of the windows when water may flow into the interior of the vehicle due to rain by detecting an external environment of the vehicle when an open signal for windows is received.

In accordance with an aspect of the present invention, an apparatus for controlling an opening and closing of vehicle windows may include an input unit configured to generate an open signal for at least one window disposed within a vehicle; a sensor unit configured to detect a rainfall at an exterior of the vehicle; and a controller configured to operate the opening and closing of the windows based on the open signal and the detected rainfall.

The controller may be configured to detect whether an opening prevention mode of the window is set. Further, the controller may be configured to open the window when the opening prevention mode is a first opening prevention mode and the open signal is input equal to a threshold number or greater. The controller may be configured to prevent the opening of the window when the opening prevention mode is a second opening prevention mode and prevent the opening of the window when the number of reception of the open signal is less than the threshold number and the detected rainfall is equal to or greater than the threshold in the first opening prevention mode. The controller may be configured to open the window when the number of reception of the open signal is less than the threshold number and the detected rainfall is less than the threshold in the first opening prevention mode.

In accordance with another aspect of the present invention, a method for controlling an opening and closing of windows of a vehicle may include: receiving, by a controller, an open signal for at least one window disposed within a vehicle; detecting, by the controller, a rainfall at an exterior of the vehicle; and operating, by the controller, the opening and closing of the windows based on the open signal and the detected rainfall. The method for controlling an opening and closing of windows of a vehicle may further include: detected, by the controller, whether an opening prevention mode of the window is set, after receiving the open signal. In addition, the method may include: detecting, by the controller, whether the opening prevention mode is a first opening prevention mode or a second opening prevention mode, after detecting whether the opening prevention mode of the window is set.

The operating of the opening and closing of the windows may include: detecting, by the controller, the number of reception of the open signal when the opening prevention mode is the first opening prevention mode; and opening, by the controller, the window when the number of reception of the open signal is equal to or greater than a threshold number. The controlling of the opening and closing of the windows may include preventing, by the controller, the opening of the window when the number of reception of the open signal is less than the threshold number and the detected rainfall is equal to or greater than the threshold, and opening, by the controller, the window when the rainfall is less the threshold in the first opening prevention mode. The controlling of the opening and closing of the windows may further include preventing, by the controller, the opening of the window when the opening prevention mode is the second opening prevention mode.

BRIEF DESCRIPTION OF THE DRAWINGS

The objects, features and advantages of the present invention will be more apparent from the following detailed description in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
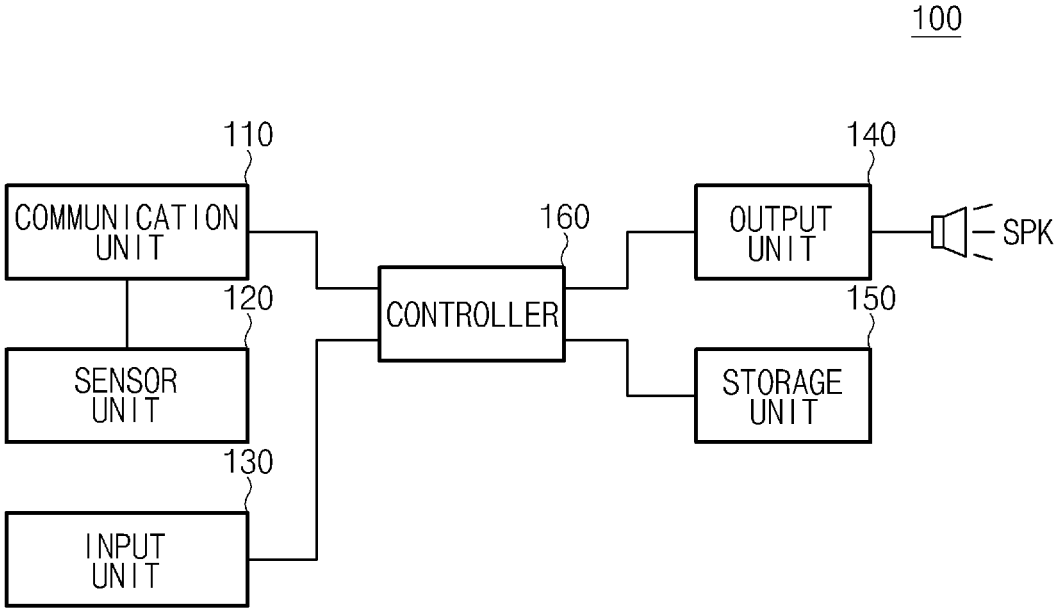
FIG. 1 is an exemplary block diagram illustrating a main configuration of an apparatus for controlling an opening and closing of vehicle windows according to an exemplary embodiment of the present invention.

FIG. 1 is an exemplary block diagram illustrating a main configuration of an apparatus for controlling an opening and closing of vehicle windows according to an exemplary embodiment of the present invention. Referring to FIG. 1, the apparatus 100 for controlling an opening and closing of vehicle windows may include a communication unit 110, a sensor unit 120, an input unit 130, an output unit 140, a storage unit 150 and a controller 160. The controller 160 may have a memory and a process and may be configured to execute the communication unit 110, the sensor unit 120, the input unit 130, the output unit 140, and the storage unit 150.

The communication unit 110 may be configured to perform controller area network (CAN) communication for communications within the vehicle to communicate with the sensor unit 120 and the controller 160. The sensor unit 120 may be mounted on an exterior of the vehicle and may be configured to sense a rainfall at the exterior of the vehicle to provide the sensing information to the controller 160.

The input unit 130 may be configured to generate an input signal input from the exterior to provide the input signal to the controller 160. In particular, the input unit 130 may include an input such as a general keypad, a touch pad, a touch screen, or the like, and may be formed of a button that generates a signal for opening and closing of at least one window disposed with the vehicle. The input unit 130 may be configured to receive a signal for opening of the windows from the exterior to provide the signal to the controller 160. In particular, when the input unit 130 is formed of the touch screen, the input unit 130 may also operate as the output unit 140.

The output unit 140 may be included in an audio, video and navigation (AVN) system, a warning light or an integrated display window of a cluster disposed within the vehicle to display the driving information of the vehicle on a screen. In particular, the output unit 140 may be configured to display a status of the exterior of the vehicle and a message notifying that an opening prevention mode of the windows is set. The output unit 140 may be formed of the touch screen or the like and may also operate as the input unit 130. In addition, the output unit 140 may include a speaker and may be configured to output a notification message notifying that the opening prevention mode of the windows is set when the open signal for the windows is received. The storage unit 150 may be configured to store a program for operating the apparatus 100 for opening and closing of the windows. In addition, the storage unit 150 may be configured to store a program for operating the AVN operations, multimedia data, map data, and the like.

The controller 160 may be configured to detect whether the opening prevention mode is set in the storage unit 150 when the open signal for the windows is received from the input unit 130. The controller 160 may be configured to open the window based on the open signal when the opening prevention mode is not set. In particular, the window may include the window located on a side of the vehicle and a sun-roof located on the upper portion of the vehicle. For an open type car, the window may be a convertible top that opens and closes the entire roof of the vehicle.

Furthermore, the controller 160 may be configured to detect the type of the opening prevention mode when the opening prevention mode is set. As a result of the detection, when a first opening prevention mode is set, the controller 160 may be configured to detect the number of reception of the open signal received from the input unit 130. When the detected number of reception of the open signal is less than a threshold number, the sensor unit 120 may be activated. The controller 160 may be configured to detect rainfall at the exterior of the vehicle from the sensing information received via the activated sensor unit 120. When the detected rainfall is equal to or greater than a threshold value, the controller 160 may be configured to prevent the water from flowing into the interior of the vehicle by preventing the opening of the vehicle window. While preventing the opening of the windows, the controller 160 may be configured to transmit the notification message notifying that the opening of the windows is prevented to the output unit 140 and the speaker SPK disposed in the output unit 140.

In addition, when the detected number of reception of the open signal is equal to or greater than the threshold number, the controller 160 may be configured to open the windows based on the input signal received through the input unit 130. When a second opening prevention mode is set, the controller 160 may be configured to prevent the opening of the windows regardless of the number of reception of the open signal and the rainfall. While preventing the opening of the windows, the controller 160 may be configured to transmit the notification message notifying that the opening of the windows is prevented to the output unit 140 and the speaker SPK disposed in the output unit 140.

Figure 2:
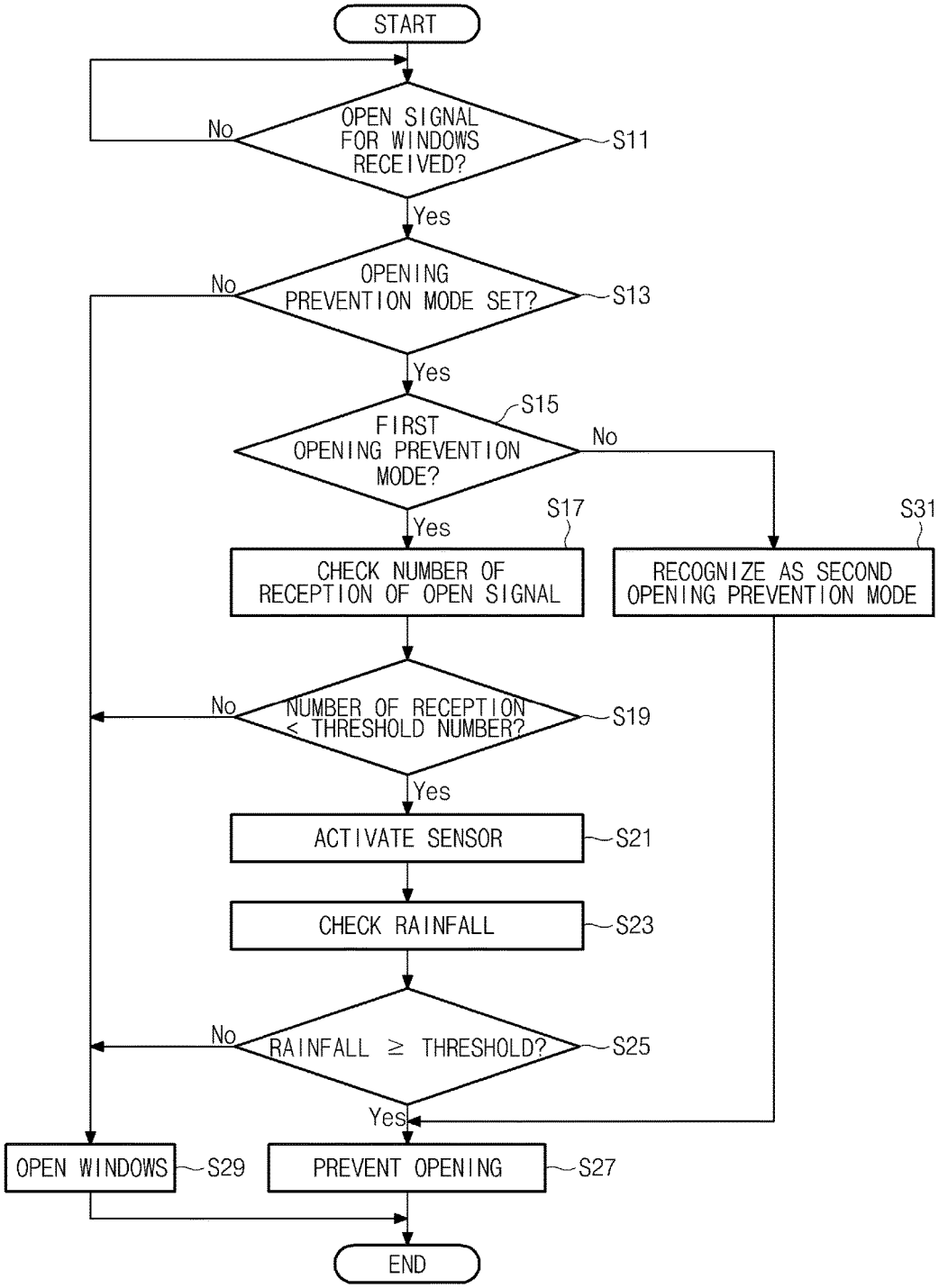
FIG. 2 is an exemplary flowchart for explaining a method for controlling an opening and closing of vehicle windows according to an exemplary embodiment of the present invention.

FIG. 2 is an exemplary flow chart for explaining a method for controlling an opening and closing of vehicle windows according to an exemplary embodiment of the present invention. Referring to FIG. 1 and FIG. 2, at step S11, the controller 160 may be configured to detect whether the open signal for opening at least one window disposed within the vehicle is received from the input unit 130. As the result of check at step S11, when the open signal is received from the input unit 130, the controller 160 may proceed to step S13.

At step S13, the controller 160 may be configured to detect whether the opening prevention mode of the windows is set. As a result of detection at step S13, when the opening prevention mode of the windows is set, the controller 160 may proceed to step S15, and when the opening prevention mode of the windows is not set, the controller 160 may proceed to step S29 to open the window based on the open signal received at step S11.

Specifically, at step S15, the controller 160 may be configured to detect whether the opening prevention mode of the windows is set to the first opening prevention mode, and the controller 160 may proceed to step S17 or step S31 based on the detection result. As a result of detection at step S15, when the first opening prevention mode is set, the controller 160 may proceed to step S17 to detect the number of reception of the open signal for opening the window and then proceed to step S19. At step S19, when the detected number of reception of the open signal is less than the threshold number, the controller 160 may proceed to step S21, and when the number of reception of the open signal is equal to or greater than the threshold number, the controller 160 may proceed to step S29 to open the windows based on the open signal received at step S11. According to the exemplary embodiment of the present invention, although the opening prevention mode of the windows is set, the window may be normally opened by reflecting a user intention (e.g., opened without detection of rain or snow).

Further, as a result of the detection at step S19, when the number of reception of the open signal is less than the threshold number, the controller 160 may proceed to step S21 to activate the sensor unit 120. At step S23, the controller 160 may be configured to detect the rainfall at the exterior of the vehicle via the sensing information received from the activated sensor unit 120. At step S25, when the rainfall at the exterior of the vehicle is equal to or greater than the threshold value, the controller 160 may proceed to step S27 to prevent the opening of the window. Then, the controller 160 may be configured to display the notification message notifying that the opening prevention mode of the windows is set on the output unit 140 and output the notification message via the speaker SPK disposed in the output unit 140.

Moreover, at step S25, when the rainfall at the exterior of the vehicle is less than the threshold value, the controller 160 may proceed to step S29 to open the window regardless of the rainfall. In addition, at step S15, when the opening prevention mode is not the first opening prevention mode, the controller 160 may proceed to step S31. At step S31, the controller 160 may be configured to determine that the opening prevention mode is the second opening prevention mode to prevent the opening of the window regardless of the reception of the open signal for the window. Then, the controller 160 may be configured to display the notification message notifying that the opening prevention mode of the windows is set on the output unit 140 and output the notification message via the speaker SPK disposed in the output unit 140.

Figure 3:
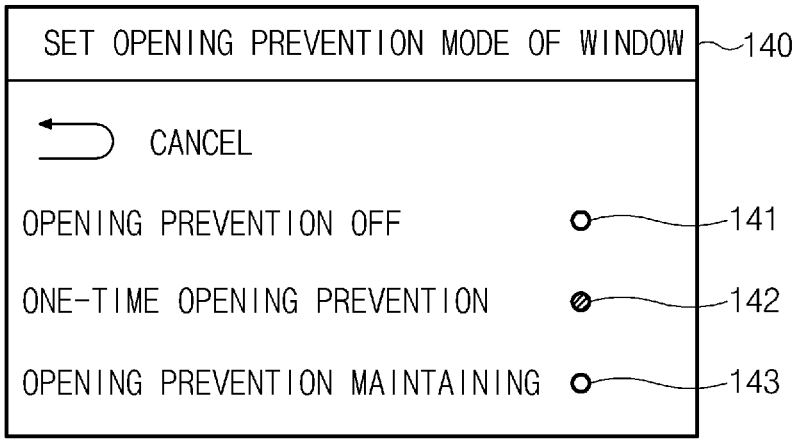
FIG. 3 is an exemplary diagram for setting of the opening and closing of vehicle windows according to an exemplary embodiment of the present invention.

FIG. 3 is an exemplary diagram for the setting of opening and closing of vehicle windows according to an exemplary embodiment of the present invention.

Referring to FIG. 1 and FIG. 3, when the user enters a menu for setting the opening prevention mode of the windows, a screen as shown in FIG. 3 may be displayed on the output unit 140. When an opening prevention off item that corresponds to reference numeral 141 is selected, the controller 160 may be configured to store the selected mode in the storage unit 150. When the opening prevention off mode of the windows is stored, the controller 160 may be configured to open the windows regardless of the rainfall at the exterior of the vehicle when the open signal for the window is received from the input unit 130. Such operations correspond to step S13 and S29 of FIG. 2.

In addition, when a one-time opening prevention item that corresponds to reference numeral 142 is selected, the controller 160 may be configured to store the selected mode in the storage unit 150. When the one-time opening prevention mode of the windows is stored, the controller 160 may be configured to detect the rainfall at the exterior of the vehicle when the open signal for the window is input via the input unit 130 equal to the threshold number, that is, one time. When the rainfall is equal to or greater than the threshold number, the controller 160 may be configured to prevent the opening of the window. Such operations correspond to step S13, step S15 to step S27 of FIG. 2.

Furthermore, when the open signal is input equal to the threshold number, that is, two times or more, the controller 160 may be configured to open the windows regardless of the rainfall at the exterior of the vehicle in response to receiving the second time open signal. Such operations correspond to step S13 to step S19 and step S29 of FIG. 2. In particular, the one-time opening prevention corresponds to the first opening prevention mode of FIG. 2, the number of the open prevention may be set by the user.

When an opening prevention maintaining item that corresponds to reference numeral 143 is selected, the controller 160 may be configured to store the selected mode in the storage unit 150. When the open prevention maintaining mode of the windows is stored, the controller 160 may be configured to prevent the opening of the windows when the open signal for the window is received from the input unit 130. Such operations correspond to step S13, step S15 and step S31 of FIG. 2, and the opening prevention maintaining item corresponds to the second opening prevention mode of FIG. 2.

As set forth above, the exemplary embodiment of the present invention may operate the opening and closing of the vehicle windows according to the external environment of the vehicle sensed by the sensor when the open signal for windows is received, thereby making it possible to prevent the status that the water may flow into the interior of the vehicle due to the rain.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the accompanying claims.

What is claimed is:

1. An apparatus for controlling an opening and closing of windows of a vehicle, the apparatus comprising:

a memory configured to store program instructions; and a processor configured to execute the program instructions, the program instructions when executed configured to:

generate an open signal input by a user for at least one window disposed within the vehicle;

if an opening prevention mode of the window is set as a first opening prevention mode, detect a rainfall at an exterior of the vehicle using a sensor; and operate the opening and closing of the windows based on a number of the open signals input by the user and the detected rainfall, wherein the program instructions when executed are further configured to open the window when the number of the input open signals is less than a threshold number and the detected rainfall is less than a threshold in the first opening prevention mode, and wherein the program instructions when executed are further configured to prevent the opening of the window when the number of the input open signals is less than the threshold number and the detected rainfall is equal to or greater than the threshold number in the first opening prevention mode.

2. The apparatus of claim 1, wherein the program instructions when executed are further configured to detect whether the opening prevention mode of the window is set.

3. The apparatus of claim 2, wherein the program instructions when executed are further configured to prevent the opening of the window when the opening prevention mode is a second opening prevention mode.

4. A method for controlling an opening and closing of windows of a vehicle, the method comprising:

receiving, by a controller, an open signal for at least one window disposed within the vehicle;

if an opening prevention mode of the window is set as a first opening prevention mode, detecting, by the controller, a rainfall at an exterior of the vehicle using a sensor;

operating, by the controller, the opening and closing of the windows based on a number of input open signals and the detected rainfall;

preventing, by the controller, the opening of the window when the number of the input open signals is less than a threshold number and the detected rainfall is equal to or greater than a threshold number; and opening, by the controller, the window when the rainfall is less than the threshold number in the first opening prevention mode.

5. The method of claim 4, further comprising:

detecting, by the controller, whether the opening prevention mode of the window is set, after receiving the open signal.

6. The method of claim 5, further comprising:

detecting, by the controller, whether the opening prevention mode is the first opening prevention mode or a second opening prevention mode, after detecting whether the opening prevention mode of the window is set.

7. The method of claim 6, wherein the controlling of the opening and closing of the windows includes:

preventing, by the controller, the opening of the window when the opening prevention mode is the second opening prevention mode.

8. A non-transitory computer readable medium containing program instructions executed by a controller, the computer readable medium comprising:

program instructions that receive an open signal for at least one window disposed within the vehicle;

program instructions that if an opening prevention mode of the window is set as a first opening prevention mode, detect a rainfall at an exterior of the vehicle using a sensor;

program instructions that operate the opening and closing of the windows based on a number of input open signals and the detected rainfall;

program instructions that prevent the opening of the window when the number of the input open signals is less than a threshold number and the detected rainfall is equal to or greater than a threshold number; and program instructions that open the window when the rainfall is less than the threshold number in the first opening prevention mode.

9. The non-transitory computer readable medium of claim 8, further comprising:

program instructions that detect whether the opening prevention mode of the window is set, after receiving the open signal.

10. The non-transitory computer readable medium of claim 9, further comprising:

program instructions that detect whether the opening prevention mode is the first opening prevention mode or a second opening prevention mode, after detecting whether the opening prevention mode of the window is set.

11. The non-transitory computer readable medium of claim 10, further comprising:

program instructions that prevent the opening of the window when the opening prevention mode is the second opening prevention mode.

* * * * *